US007330090B2

(12) United States Patent
Itoh et al.

(10) Patent No.: US 7,330,090 B2
(45) Date of Patent: Feb. 12, 2008

(54) ZEROETH-ORDER RESONATOR

(75) Inventors: Tatsuo Itoh, Rolling Hills, CA (US); Atsushi Sanada, Yamaguchi (JP); Christophe Caloz, Quebec (CA)

(73) Assignee: The Regents of the University of California, Oakland, CA (US)

( * ) Notice: Subject to any disclaimer, the term of this patent is extended or adjusted under 35 U.S.C. 154(b) by 250 days.

(21) Appl. No.: 11/092,143

(22) Filed: Mar. 28, 2005

(65) Prior Publication Data

US 2006/0066422 A1 Mar. 30, 2006

Related U.S. Application Data

(60) Provisional application No. 60/556,982, filed on Mar. 26, 2004.

(51) Int. Cl.
*H01P 7/08* (2006.01)

(52) U.S. Cl. ..... 333/219; 333/236; 333/245

(58) Field of Classification Search ..... 333/219, 333/236, 239, 246
See application file for complete search history.

(56) References Cited

OTHER PUBLICATIONS

Lai et al "Composite Right/Left Handed Transmission Line Metamaterials" Sep. 2004, IEEE Microwave Magazine pp. 34-50.*
Tatsuo Itoh et al., "Application Of The Transmission Line Theory Of Left-Handed (LH) Materials . . . ", Jun. 2002, pp. 412-415, IEEE-APS Int'l Symp. Digest, vol. 2.
V. G. Veselago, "The Electrodynamics of Substances with Simultaneously Negative Values of ϵ andμ, Jan.-Feb. 1968, pp. 509-514,"Soviet Physics Uspekhi, vol. 10, No. 4.
R. A. Shelby et al., "Experimental Verification Of A Negative Index Of Refraction", 2002, pp. 77-79, Science, vol. 292 No. 6.
J. B. Pendry, "Negative Refraction Makes A Perfect Lens," Oct. 2000, pp. 3966-3969, Phys. Rev. Lett., vol. 85, No. 18.
R. Mongia et al., "RF and Microwave Coupled-Line Circuits", 1999, Norwood MA. Artech House.
J. Lange, "Interdigital Stripline Quadrature Hybrid", IEEE Trans. Microwave Theory and Tech, Dec. 1969, pp. 1150-1151, vol. MTT-26.
D. R. Smith et al., "Composite Medium with Simultaneously Negative Permeability and Permittivity," May 2000, pp. 4184-4187, Phys. Rev. Lett., vol. 84, No. 18.

(Continued)

*Primary Examiner*—Robert Pascal
*Assistant Examiner*—Kimberly E Glenn
(74) *Attorney, Agent, or Firm*—John P. O'Banion

(57) ABSTRACT

A high frequency resonator circuit and method of fabrication is described which has a resonant frequency independent of physical resonator dimensions. The resonator operates in a zeroeth-order mode on a composite right/left-handed (CRLH) transmission line (TL). The LH wave properties of the CRLH-TL contributing anti-parallel phase and group velocities. In one variation, the unit cells are formed from microstrip techniques, preferably creating alternating interdigitated capacitors and stub inductors. The resonant wavelength of the resonator is dependent on the electrical characteristics of the unit cells and not the physical size of the resonator in relation to the desired resonant wavelength. The resonator is created with at least 1.5 unit cells and the Q of the resonator is substantially independent of the number of unit cells utilized. The resonator circuit is particularly well suited for reducing resonator size, and allows resonators of various wavelengths to be fabricated within a fixed board area.

20 Claims, 10 Drawing Sheets

OTHER PUBLICATIONS

J. B. Pendry et al., "Magnetism from Conductors and Enhanced Nonlinear Phenomena," Nov. 1999, pp. 2075-2084, IEEE Trans. Microwave Theory and Tech, vol. 47, No. 11.

Tatsuo Itoh et al., "Transmission Line Approach of Left-Handed (LH) Materials," Jun. 2002, p. 39, USNC/URSI National Radio Science Meeting, vol. 1, San Antonio, TX.

A. K. Iyer et al., "Negative Refractive Index Metamaterials Supporting 2-D Waves," Jun. 2002, pp. 1067-1070, IEEE-MTTInt'l Symp., Seattle WA.

Tatsuo Itoh et al., "Dominant Mode (MD) Leaky Wave Antenna with Backfire-to-Endfire Scanning Capability", Nov. 2002, pp. 1414-1416, Electron. Lett. vol. 38 No. 23.

S. Ramo et al., "Fields and Waves in Communication Electronics," 2002, John Wiley and Sons.

J. B. Pendry, "Negative Refraction Makes a Perfect Lens," Nov. 2003, Electron. Letter No. 23.

R. W. Vogel, "Analysis And Design Of Lumped and Lumped-Distributed- . . . ", Feb. 1992, pp. 253-262, IEEE Trans. Microwave Theory Tech., vol. 40, No. 2.

T. Hirota et al., "Reduced-size Branch-line and Rat-race Hybrids for Uniplanar MMIC's", Mar. 1990, pp. 270-275, IEEE Trans. Microwave Theory Tech., vol. 38, No. 3.

L. Fan et al., "Wide-band Reduced-V-size Uniplanar Magic-T . . . ", Dec. 1995, pp. 2749-2758, IEEE Trans. Microwave Theory Tech., vol. 43, No. 12.

A. Hellemans, "Left-Handed Material Reacts to 3-D Light", Oct. 2002, pp. 24-26, IEEE Spectrum, vol. 39.

R. A. Shelby et al., "Microwave transmission through a two-dimensional, isotropic, left-handed material", Jan. 2001, pp. 489-491, App. Phys. Lett., vol. 78, No. 4.

L. H. Lu et al., "Design and Implementation of Micromachined Lumped Quadrature (90) Hybrids", Jun. 2001, pp. 1285-1288, 2001 IEEE MTT-S Int. Microwave Symp. Dig. vol. 2.

J. Reed et al., "A Method of Analysis of Symmetrical Four-Port Networks" Oct. 1956, pp. 246-252, IRE Trans. on Microwave . . . , vol. MTT-4.

* cited by examiner

Equivalent circuit of the 7-cell ZOR

ZEROETH-ORDER RESONATOR

CROSS-REFERENCE TO RELATED APPLICATIONS

This application claims priority from U.S. provisional application Ser. No. 60/556,982 filed on Mar. 26, 2004, incorporated herein by reference in its entirety.

STATEMENT REGARDING FEDERALLY SPONSORED RESEARCH OR DEVELOPMENT

This invention was made with Government support under Grant No. N00014-01-0803, awarded by the Department of Defense Office of Naval Research. The Government has certain rights in this invention.

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to transmission lines, and more particularly to a zeroeth-order strip resonator.

2. Description of Related Art

Generally speaking, the resonant frequency of a conventional distributed open-ended or short-ended TL resonator depends on its physical length, while the lowest mode of the resonator is the first-order (n=1) mode where the guided wavelength $\lambda_g$ becomes identical to twice the length of the resonator (2l). Currently, resonator size is determined by the desired resonating wavelength.

Accordingly a need exists for an enhanced resonator which can be implemented for any desired resonant frequency without altering physical resonator dimensions.

BRIEF SUMMARY OF THE INVENTION

A novel resonator is described that utilizes composite right/left-handed (CRLH) transmission line (TL) based on the novel concept of zeroeth-order resonance characterized by an infinite-wavelength wave in the CRLH-TL.

The resonator is called zeroeth-order resonator (ZOR) by analogy with the conventional TL resonant mode numbering. The resonant frequency determined in response to the electrical characteristics of the CRLH-TL and independent of the physical size. It is expected that the present invention can lead to significant resonator size reductions, since theoretically the size of the ZOR can be made arbitrarily small on condition that sufficient reactance can be introduced into a short length.

The ZOR is based on a novel concept of zeroeth-order resonance using an infinite-wavelength wave of the CRLH-TL. It should be noted that the LH wave is a wave that has anti-parallel phase and group velocities. In contrast, an ordinary wave with parallel phase and group velocities is referred to as RH wave. The CRLH-TL is one approach for realization of the left-handed (LH) materials based on the meta-structured transmission line theory, which supports both the left-handed (LH) and right-handed (RH) waves in different frequency ranges. The CRLH-TL also supports an extraordinary infinite-wavelength wave at one or two frequencies, whereas the conventional TLs support an infinite-wavelength wave only at a zero frequency (DC). The ZOR uses one of the two infinite-wavelength frequencies.

In contrast with conventional resonators whose resonant frequency depends on its physical length, the inventive ZOR resonates with the infinite-wavelength wave corresponding to the zeroeth-order resonance in the conventional notation, the resonance is fundamentally independent of its physical length. The resonant frequency is determined not by its physical length but by its electrical parameters, or more precisely, it is determined by the equivalent shunt inductance and shunt capacitance of the TL, as shown in the following section in detail.

The loss mechanism of the ZOR is also different from that of a conventional TL resonator because of the infinite-wavelength wave in the ZOR. In the infinite-wavelength state, no power is dissipated by the series resistance along the ZOR, whereas, for conventional TL resonators, the loss by the series resistance along the TL is a dominant part of the total loss of the resonator. Instead, the loss of the ZOR is dominated by that of a shunt tank resonator in the unit cell, which is indicative of the independence between resonant wavelength and number of unit cells. Losses of the ZOR can be reduced by optimizing the structure of the shunt tank resonator.

The theory of the ZOR has been established and the resonant characteristics and the loss mechanism has been explained. The ZORs described herein are designed and implemented with the microstrip line technology based on the meta-structured CRLH-TL concept. Numerical and experimental evidence of the existence of the zeroeth-order resonance in microwave frequency are presented. By way of example a 61% size reduction (i.e., from 57.6 mm to 22.4 mm) was provided within one embodiment of a ZOR designed at 1.9 GHz. The experimental ZOR exhibited an unloaded Q of 250 which compares favorably with conventional open-ended TL resonators.

The inventive ZORs according to the present invention have wide-ranging applicability and can provide useful resonator size reductions within a wide range of fields. One particularly advantageous application is for producing microwave resonators within high frequency circuit devices for use within mobile or satellite communication systems, such as filters, oscillators, and so on. The term high frequency is utilized herein to denote circuits operating in at least the high megahertz range (i.e., >100 MHz), and more preferably within the gigahertz to terahertz range. The resonator thereby is configured for operation within, near, or above the gigahertz range.

The invention is amenable to embodiment in numerous ways, including but not limited to the following descriptions.

An embodiment of the invention may be generally described as a resonator apparatus, comprising: (a) a composite right/left-handed (CRLH) transmission line (TL), in which the LH-TL contributes anti-parallel phase and group velocities; (b) means for combining unit cells having a desired equivalent shunt inductance and shunt capacitance within the CRLH-TL; (c) at least one input and output port on the resonator for coupling high frequency signals into and out of the resonator; and (d) wherein the TL is configured for resonating at the zeroeth-order characterized by an infinite-wavelength wave in the CRLH-TL and has a resonant frequency which is independent of the physical size characteristics of the resonator.

The inventive resonator provides a number of benefits, such as having negligible series resistive power dissipation which is typically at least an order of magnitude less than the series resistance dissipated by conventional resonators of similar wavelength and characteristics.

In one embodiment of the invention the means for combining unit cells having a desired equivalent shunt inductance and shunt capacitance may comprise multiple passive components in each unit cell including at least one interdigitated capacitor operably coupled to at least one stub inductor (i.e., a single interdigitated capacitor coupled to a single inductor); and in which passive components from adjacent unit cells are operable coupled to one another within the CRLH-TL.

An embodiment of the invention may also be described as a method of implementing high frequency resonators, comprising: (a) forming an inductor-capacitor (LC) unit cell; (b) coupling at least 1.5 unit cells into a composite right/left-handed (CRLH) transmission line (TL) configured for resonating at the zeroeth-order characterized by an infinite-wavelength wave in the CRLH-TL which is independent of the physical size characteristics of the resonator; and (c) coupling at least one input port and output port to the CRLH-TL.

Embodiments of the present invention can provide a number of beneficial aspects which can be implemented either separately or in any desired combination without departing from the present teachings.

An aspect of the invention is a resonator apparatus in which the resonant frequency is not dependent on the physical size characteristics of the resonator.

Another aspect of the invention is the creation of a resonator which is suitable for use within high frequency circuit devices within mobile or satellite communication systems, such as filters, oscillators, and so forth.

Another aspect of the invention is the creation of a resonator which is particularly well suited for use in microwave resonators.

Another aspect of the invention is the creation of a zeroeth-order resonator based on a composite right/left-handed (CRLH) transmission line (TL) which is characterized by an infinite-wavelength wave in the CRLH-TL.

Another aspect of the invention is a resonator comprising multiple TL unit cells.

Another aspect of the invention is a resonator in which the resonant frequency depends on the electrical characteristics of the unit cell and is independent of resonator size characteristics.

Another aspect of the invention is a resonator apparatus that can be fabricated in sizes which are much smaller than conventional resonators.

Another aspect of the invention is a resonator apparatus in which one physical design can be used for numerous wavelengths by altering component values.

Another aspect of the invention is a resonator that employs the LH wave which has anti-parallel phase and group velocities.

Another aspect of the invention is a resonator utilizing LH wave based on the meta-structured transmission line theory, which supports both the left-handed (LH) and right-handed (RH) waves in different frequency ranges.

Another aspect of the invention is a resonator apparatus whose resonant wavelength is determined by the equivalent shunt inductance and shunt capacitance of the TL.

Another aspect of the invention is a resonator in which resonator losses are dominated by the losses exhibited by the shunt tank resonator in the unit cell.

Another aspect of the invention is a resonator having insignificant dissipation loss from the series resistance, in contrast with conventional transmission line resonators in which the series resistance loss typically dominants the total losses of the resonator.

Another aspect of the invention is a resonator fabricated using microstrip line technology.

Another aspect of the invention is a resonator fabricated from multiple TL unit cells each of which consists of a series interdigitated capacitor and a shunt stub inductor.

Another aspect of the invention is a resonator that can be fabricated with an arbitrary number of unit cells.

Another aspect of the invention is a resonator in which the unloaded Q of the resonator is independent of the number of unit cells.

Another aspect of the invention is a resonator that can be implemented to provide an unloaded Q of at least 250.

Another aspect of the invention is a resonator of N unit cells having a resonant frequency ω following that of the LC tank circuit, having an inductance of $L_L/N$ and a capacitance of $NC_R$, as given by:

$$\omega = \frac{1}{\sqrt{(L_L/N)\cdot NC_R}} = \frac{1}{\sqrt{L_L C_R}} = \omega_{sh}$$

Another aspect of the invention is a resonator apparatus of a zeroeth-order comprising a plurality of LC unit cells coupled to two ports with gaps at the ends.

A still further aspect of the invention is a resonator configured to support an infinite wavelength wave at a finite and non-zero frequency.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1A through FIG. 8B. It will be appreciated that the apparatus may vary as to configuration and as to details of the parts, and that the method may vary as to the specific steps and sequence, without departing from the basic concepts as disclosed herein.

1. SCHEMATIC AND RESONANT FREQUENCY OF ZOR

Figure 1A:
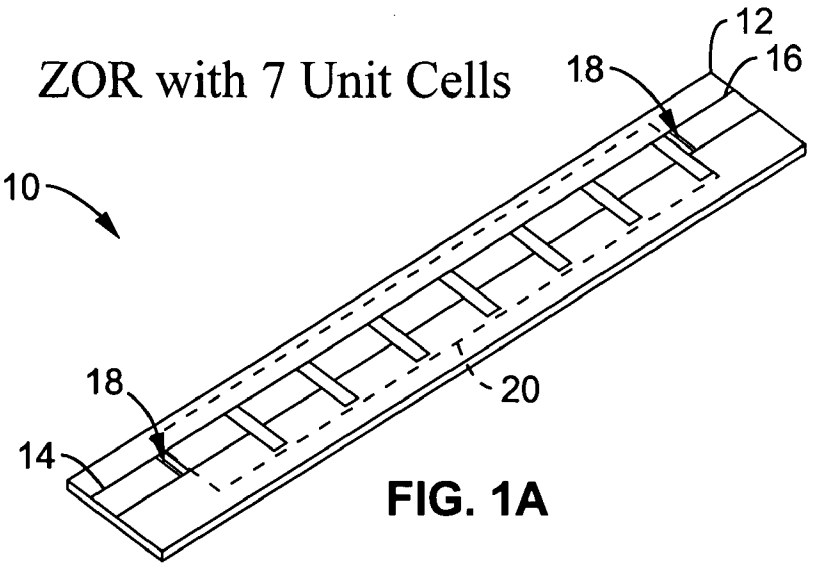
FIG. 1A is a perspective view of a resonator according to an embodiment of the present invention, shown having 7 unit cells.

FIG. 1A illustrates by way of example embodiment 10 a zero-order resonator (ZOR) implemented with microwave microstrip line technology on a substrate, printed circuit material, or similar 12. An input port 14 and output port 16 are shown coupled to the unit cells of the resonator, such as via gap 18. A series of unit cells 20 is shown coupled between the input and output ports. The resonator of this embodiment is fabricated with a composite right/left-handed transmission line (CRLH-TL) having seven (7) unit cells each of which consists of a series interdigital capacitor and a shunt stub inductor. The number of the unit cells is arbitrary with regard to determining resonant characteristics, however, increasing the number of unit cells brings the TL closer to the ideal CRLH-TL and accurate prediction of the TL characteristics based on the CRLH-TL theory can be made.

Figure 1B:
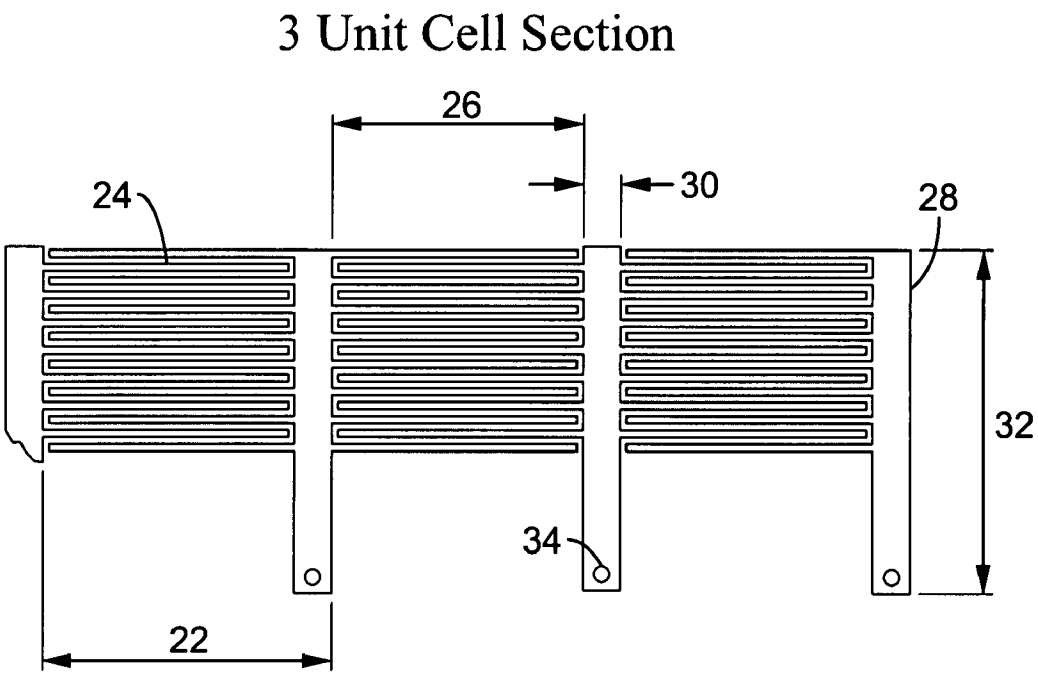
FIG. 1B is a facing view of unit cells within the resonator in FIG. 1A.

FIG. 1B illustrates three unit cells from a series of unit cells 20 shown in FIG. 1A. A single unit cell comprises interdigitated capacitor 24, having finger elements of length 26, and an inductor 28 exemplified as a stub having width 30 and length 32. Feed through vias 34 are shown for connecting to a ground (i.e., ground plane) on the opposing surface of the substrate.

Based on the CRLH-TL theory as described, the characteristic impedance, the phase constant and the dispersion relation are given as follows.

$$\text{Characteristic impedance: } Z_0 = Z_{0L}\sqrt{\frac{\omega^2/\omega_{se}^2 - 1}{\omega^2/\omega_{sh}^2 - 1}}, \tag{1}$$

$$\text{Phase constant: } \beta = \sqrt{\frac{\omega_L^2}{\omega^2}\left(\frac{\omega^2}{\omega_{sh}^2} - 1\right)\left(\frac{\omega^2}{\omega_{sh}^2} - 1\right)}, \tag{2}$$

$$\text{Dispersion relation: } \beta d = \cos^{-1}\left\{1 - \frac{1}{2}\left[\frac{\omega_L^2}{\omega^2} + \frac{\omega^2}{\omega_R^2} - \left(\frac{\omega_L^2}{\omega_{se}^2} + \frac{\omega_L^2}{\omega_{sh}^2}\right)\right]\right\}, \tag{3}$$

$$\text{where } \omega_L = \frac{1}{\sqrt{L'_L C'_L}},\ \omega_R = \frac{1}{\sqrt{L'_R C'_R}},\ \omega_{se} = \frac{1}{\sqrt{L'_R C'_L}},\ \omega_{sh} = \frac{1}{\sqrt{L'_L C'_R}}, \tag{4}$$

$$\text{and } Z_{0L} = \sqrt{\frac{L'_L}{C'_L}}. \tag{5}$$

Figure 2A:
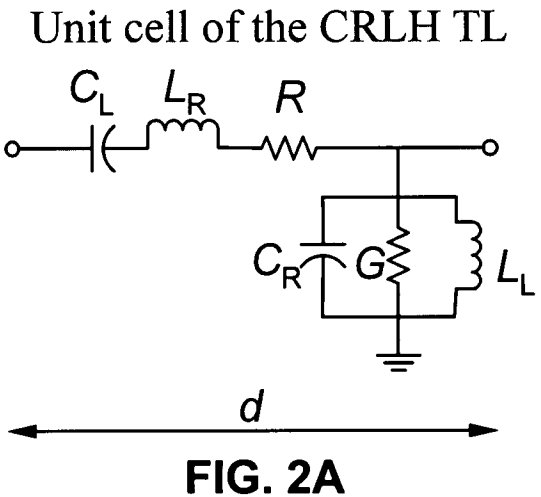
FIG. 2A is a schematic representation of a unit cell of the CRLH-TL according to an aspect of the present invention.
Figure 2B:
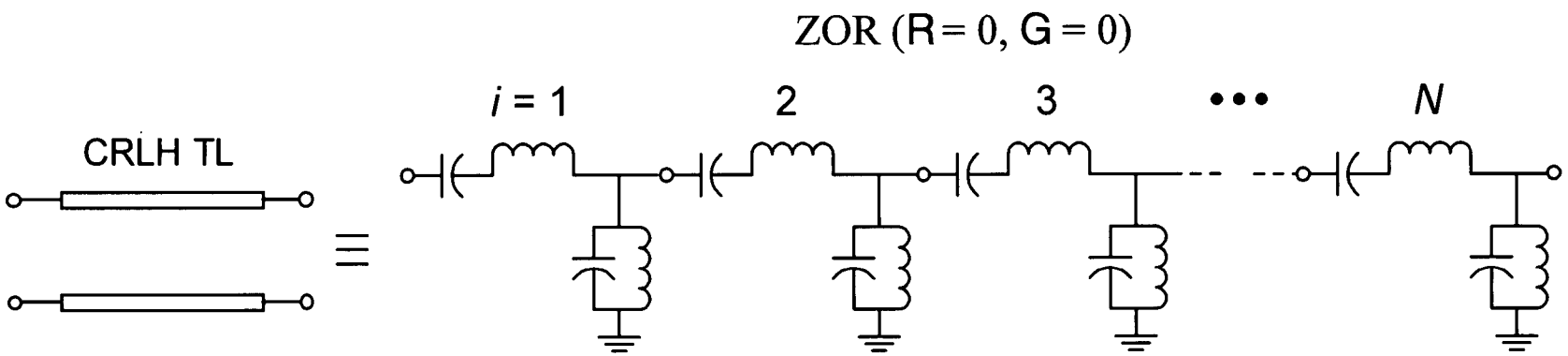
FIG. 2B is a schematic representation of the zeroeth-order resonator (ZOR) according to an aspect of the present invention, showing multiple unit cells with R=0 and G=0.

FIG. 2A and FIG. 2B illustrate equivalent circuits of the ZOR. In FIG. 2A the equivalent circuit of a single unit cell is represented and in FIG. 2B the ZOR with multiple unit cells having R=0 and G=0 is depicted. In FIG. 2A it can be seen that β, $C'_L$, $L'_R$, and $C'_R$ are the element values of the CRLH-TL equivalent circuit for the unit cell in H·m, F·m, H/m and F/m respectively. In this case $L'_L$ and $C'_L$ represent the LH nature and $L'_R$ and $C'_R$ represents the nature of the inevitable parasitic series inductance and capacitance.

The equivalent circuit of the ZOR is shown in FIG. 2B as a realization of a cascaded connection of a finite number of unit cells. According to the dispersion relation of Eq. (3) of the CRLH-TL theory, the resonant frequencies of the ZOR are the solutions of the following equation for each mode number n.

$$\beta_n d = \frac{n\pi d}{l} = \frac{n\pi}{N} = \cos^{-1}\left\{1 - \frac{d^2}{2}\left[\frac{\omega_L^2}{\omega_n^2} + \frac{\omega_n^2}{\omega_R^2} - \left(\frac{\omega_L^2}{\omega_{se}^2} + \frac{\omega_L^2}{\omega_{sh}^2}\right)\right]\right\}, \quad (n = 0, \pm 1, \pm 2, \ldots, \pm(N-1)) \tag{6}$$

In the above equation d represents the length of the unit cell, l is the total length of the resonator and N is the total number of the unit cells used in the ZOR. Positive values of n correspond to the conventional RH resonance and negative values of n correspond to the LH resonance with negative values for β. For n=0, the wavelength becomes infinite at the finite angular frequencies given by the following.

$$\omega = \omega_{se}, \omega_{sh} \tag{7}$$

Figure 3B:
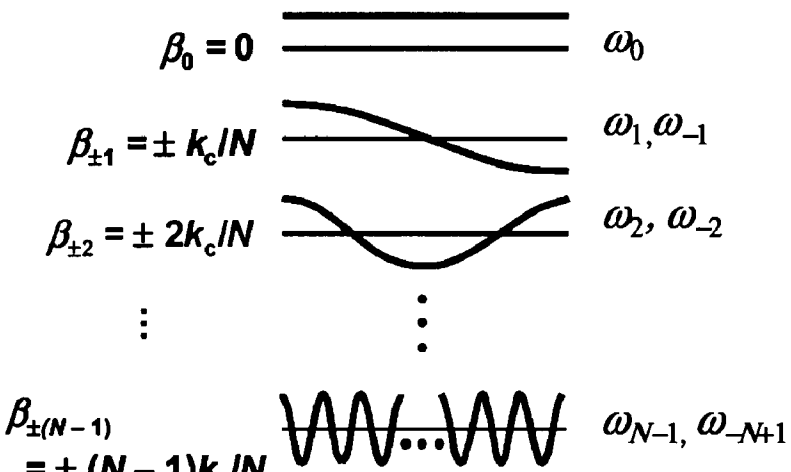
FIG. 3B is a graph of resonant modes for a ZOR according to an embodiment of the present invention.
Figure 3A:
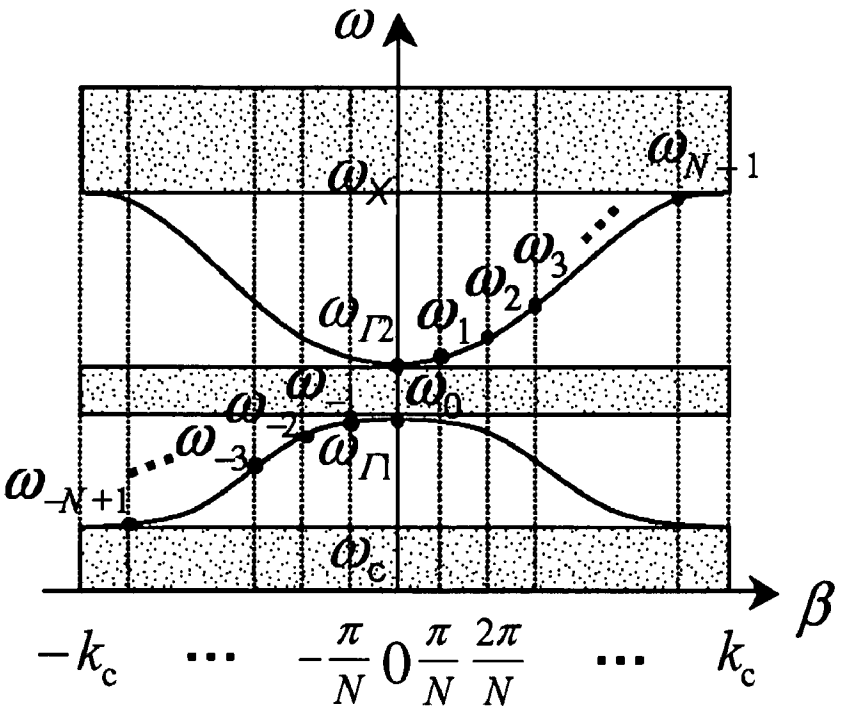
FIG. 3A is a graph of resonant angular frequencies for a ZOR according to an embodiment of the present invention, shown in a β-ω diagram.

FIG. 3A and FIG. 3B illustrate the solution of Eq. (6) depicted in a β-ω diagram. FIG. 3A illustrates resonant angular frequencies and FIG. 3B illustrates resonant modes. These solutions are arranged with the equal distance of π/N along the β axis as marked by dots.

Figure 4A:
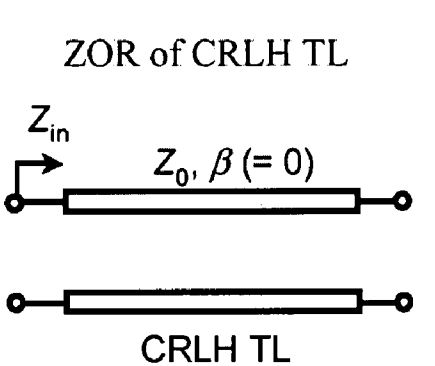
FIG. 4A is a symbolic representation of a ZOR by way of example according to an embodiment of the present invention, showing two transmission line connections.
Figure 4B:
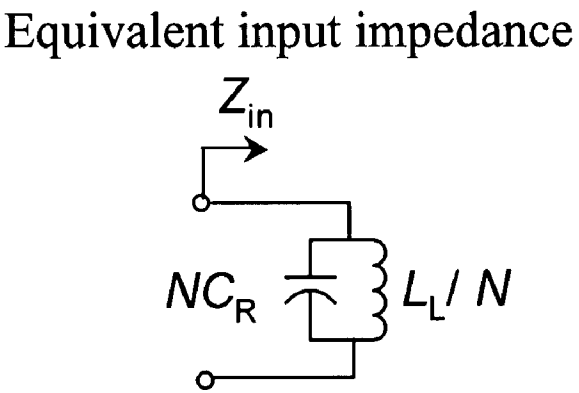
FIG. 4B is a schematic of an equivalent input impedance for a ZOR according to an embodiment of the present invention.

FIG. 4A and FIG. 4B illustrates a ZOR in the resonance state. Although both the two frequencies of Eq. (7) yield the infinite-wave in the CRLH-TL, the zeroeth-order resonance occurs only at the angular frequency $\omega_{sh}$. To explain the frequency of the resonance, let us by way of example consider the lossless open-ended ZOR of FIG. 4A. When β is small (β→0), the input impedance $Z_{IN}$ from one of the open-ends toward the other end is given as by the following equation.

$$\begin{aligned} Z_{in} &= -jZ_0\cot\beta l \\ &\approx -jZ_o\frac{1}{\beta l} \qquad (\beta \sim 0) \\ &= -j\sqrt{\frac{Z'}{Y'}}\left(\frac{1}{-j\sqrt{Z'Y'}}\right)\frac{1}{l} \\ &= \frac{1}{Y'l} = \frac{1}{Y'(Nd)} = \frac{1}{NY} \end{aligned} \tag{8}$$

In this case, $Z'=j(\omega L_L-1/\omega C_R)/d$, $Y'=j(\omega L_R-1/\omega C_L)/d$ and $Y=Y'd$. Therefore, $Z_{in}$ becomes that of the LC tank resonant circuit with an inductance with the value of $L_L/N$ and a capacitance with the value of $NC_R$ as shown in FIG. 4B. The resonant frequency, therefore, is given by the following.

$$\omega = \frac{1}{\sqrt{(L_L/N)\cdot NC_R}} = \frac{1}{\sqrt{L_L C_R}} = \omega_{sh} \tag{9}$$

It should be noted that the ZOR resonates at $\omega_{sh}$, not at $\omega_{se}$ ($\neq\omega_{sh}$). Incidentally, for a special case of $\omega=\omega_{sh}=\omega_{se}$, still a resonance occurs in the ZOR because Eq. (9) shows that resonance is still exhibited at the angular frequency.

In summary, the resonant frequency of the ZOR is again given by the following.

$$\omega_{sh} = \frac{1}{\sqrt{L'_L C'_R}} = \frac{1}{\sqrt{L_L C_R}} \tag{10}$$

Eq. (10) suggests that the angular frequency depends only on the shunt inductance $L_L$ and the shunt capacitance $C_R$ of the unit cell, not the physical length l of the ZOR.

Figure 5A:
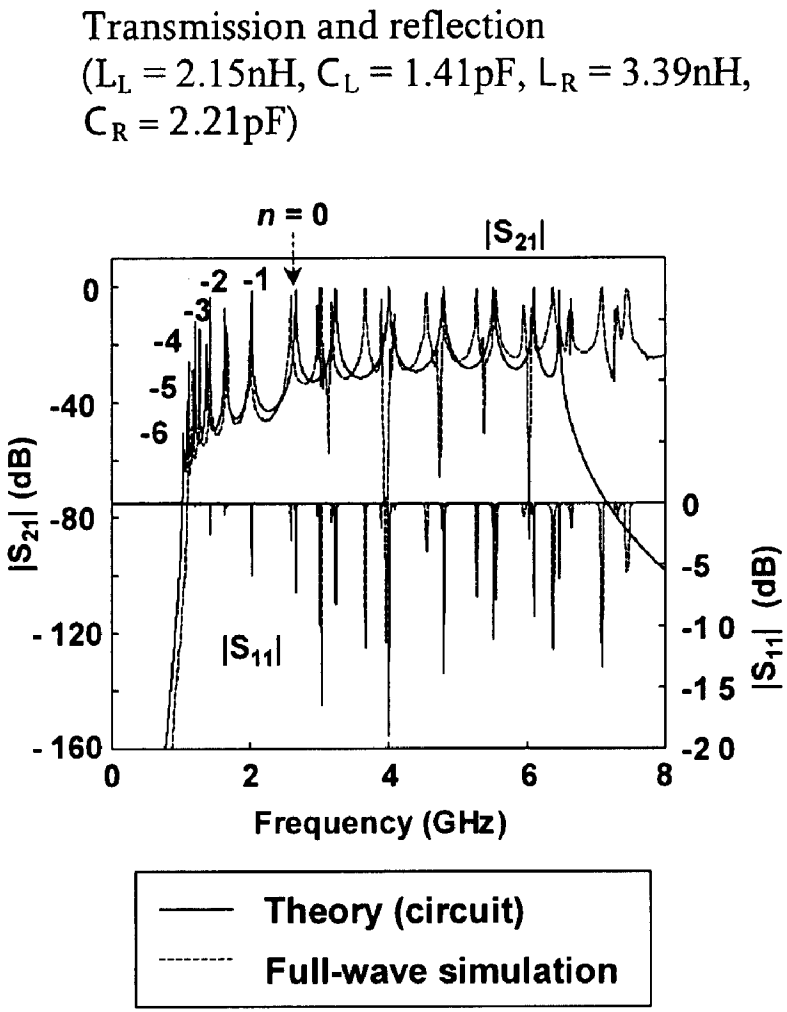
FIG. 5A is a graph of transmission and reflection characteristics for ZOR according to an aspect of the present invention, showing a comparison between theoretical ZOR values and those obtained from a full-wave simulation.

FIG. 5A illustrates transmission and reflection characteristics of the ZOR coupled to two ports with gaps at the ends. Simulations for an implemented ZOR shown in FIG. 1 were carried out and depicted in FIG. 5A in order to validate the theory outlined above using a full-wave method of moment (MoM) which shows that the transmission and reflection characteristics of the ZOR coupled to two ports with gaps at the ends. The thick lines show corresponding theoretical results given from the equivalent circuit shown in FIG. 5A. The circuit parameters were extracted for the unit cell shown in FIG. 1 by full-wave MoM simulations in advance. The thin lines are MoM results applied to the entire structure of the ZOR. The zeroeth-order resonance peaks appear exactly at the frequency of 2.5 GHz given by Eq. (10) in the theoretical transmission characteristic and also the numerical results exhibits the resonance at the frequency within the numerical error range. The major error is due to the simulator ignorance of the higher order modes in the equivalent element-values extractions.

Figure 5B:
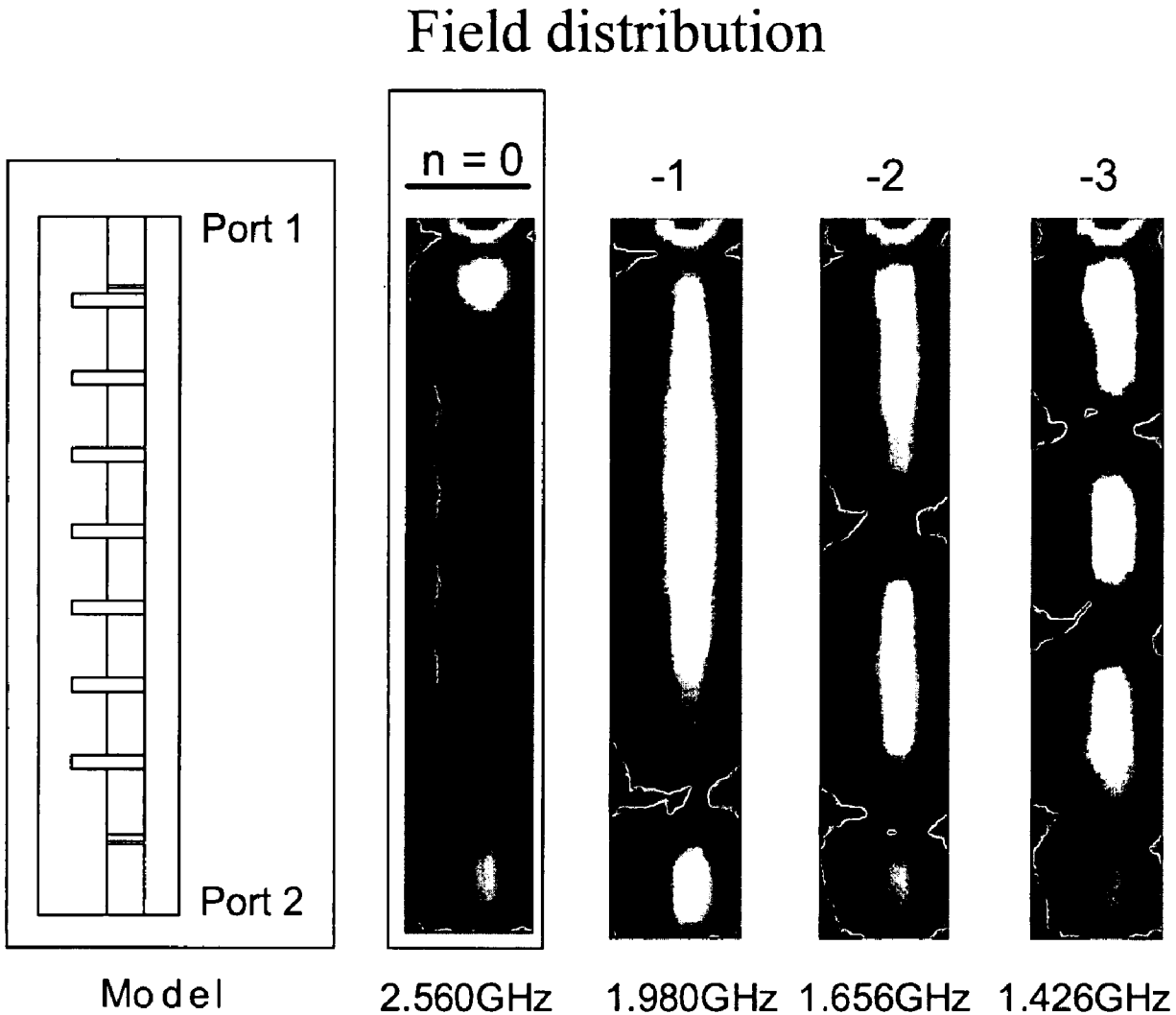
FIG. 5B is a facing view of a ZOR according to an aspect of the present invention, shown accompanied by images generated by a full-wave method of moment (MoM) simulation for the model ZOR.

FIG. 5B shows the electric field distributions 1.5 mm ($=0.013\lambda_0$) above the ZOR surface in the zeroeth-order resonant state as well as some off-resonant states of n=−1, −2 and −3 as a comparison. A series of five images from the simulator output are shown. The left-most portion depicts a model of the ZOR under simulation (shown with seven unit cells between input and output ports), with the remaining depictions showing simulations at different frequencies with $n\in\{0, -1, -2, -3\}$. The equal-voltage state, (i.e., the infinite-wavelength wave resonance state) is observed at the theoretically predicted resonant frequency. These simulation results clearly show the validity of the theory.

Figure 6:
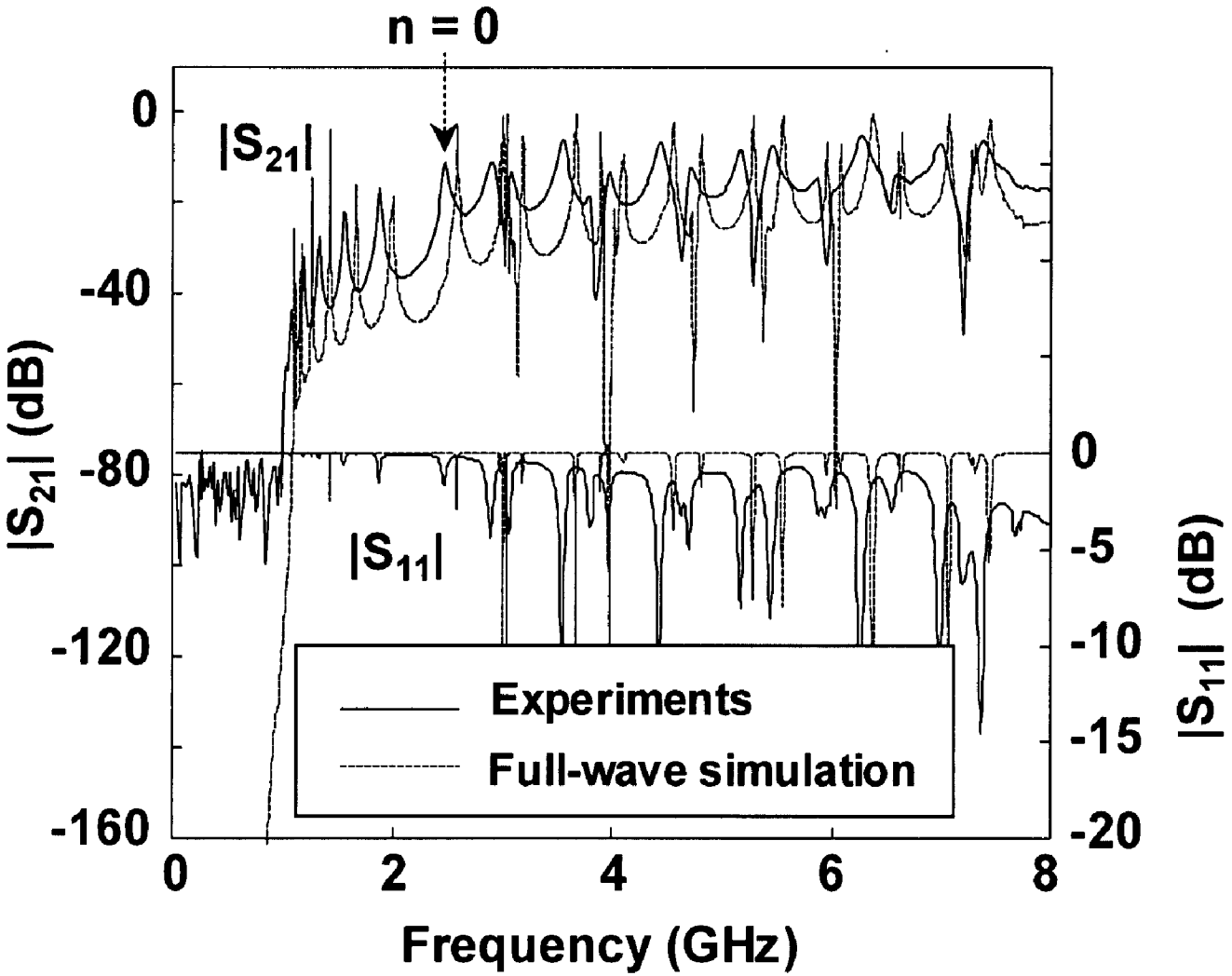
FIG. 6 is a graph of transmission and reflection characteristics for a ZOR according to an aspect of the present invention, showing a comparison between simulated ZOR values and those obtained from experimentation.
Figure 7A:
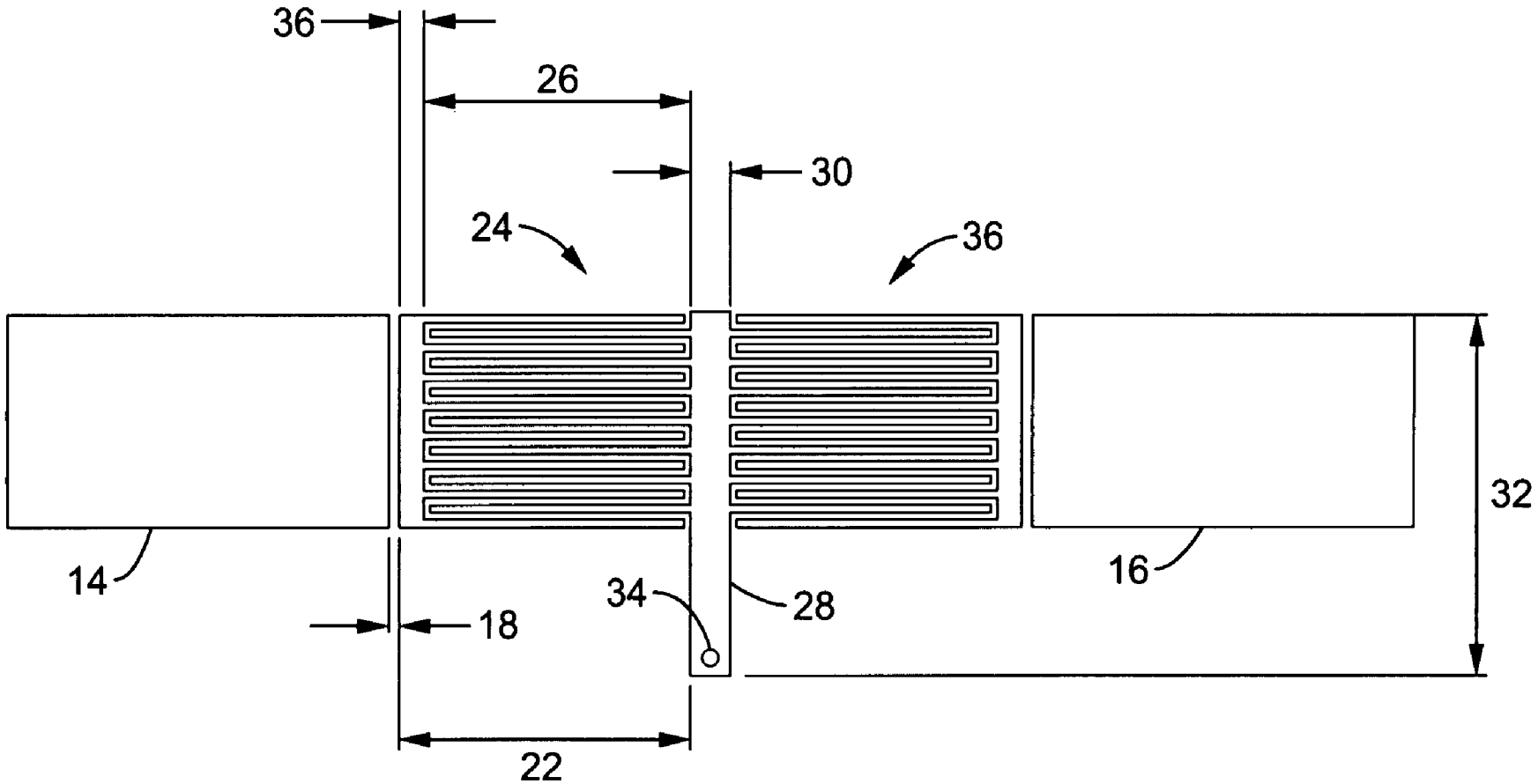
FIG. 7A is a facing view of a 1.5 unit cell ZOR structure according to an aspect of the present invention, showing interdigitated capacitors and a single inductive stub therebetween.
Figure 7B:
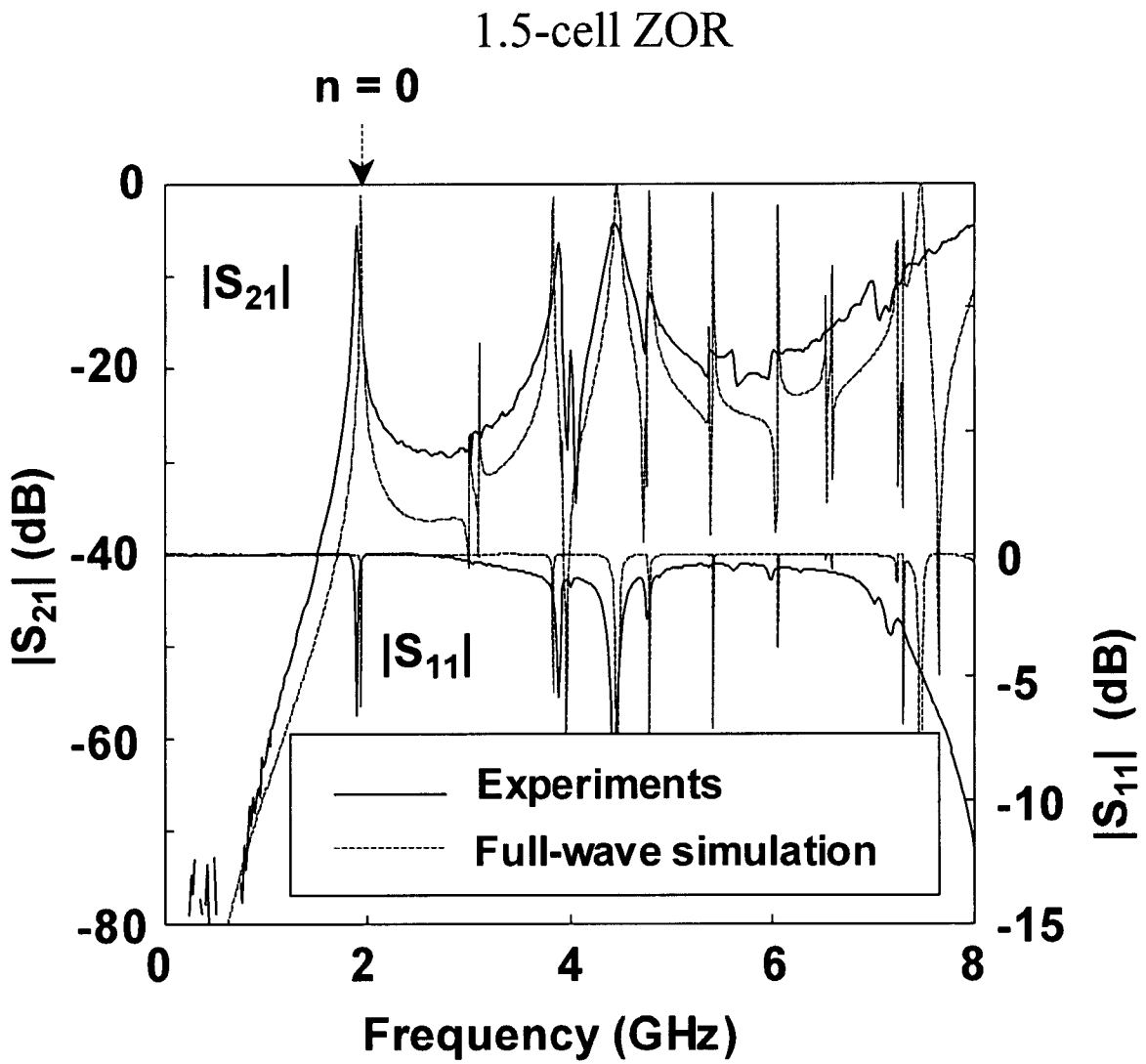
FIG. 7B is a graph of frequency characteristics for the ZOR shown in FIG. 7A.

FIG. 6 and FIG. 7B illustrate measured frequency characteristics determined as a result of tests carried out for the 7-cell ZOR shown in FIG. 1 and the 1.5-cell ZOR shown in FIG. 7A, respectively. In FIG. 7A the 1.5 unit cell resonator comprises an input port 14, first interdigitated capacitor 24, a single inductor stub 28 with feed through via 34, and second interdigitated capacitor 36 coupled to output port 16.

The measured resonant frequencies were found to be 2.47 GHz (7-cell) and 1.9 GHz (1.5-cell), respectively, which agree well with the simulated results and the existence of the zeroeth-order resonance is confirmed. The total length of the 1.5-cell ZOR is 22.4 mm, whereas the length of a conventional half-wavelength resonator with the same resonant frequency at 1.9 GHz on the same substrate is 57.6 mm. Therefore, it can be seen that the inventive ZOR achieves a 61% size reduction in relation to a conventional resonator. It should be appreciated that the ZOR presented here was not optimized for size reduction but for convenience of the described tests. It is expected that further size reduction can be achieved within more optimized designs.

2. LOSS MECHANISM

The loss mechanism of the ZOR at the zeroeth-order resonant state is also different from that of conventional resonators due to the infinite-wavelength wave in the ZOR. As an aid to understanding that difference, let us consider a ZOR in the resonant state. At the resonant frequency $\omega_{sh}$, the voltages at each node of the ZOR is identical due to the infinite-wavelength wave while no current flows along the series resister R. Consequently, no power is dissipated by the series resistance R.

Figure 8A:
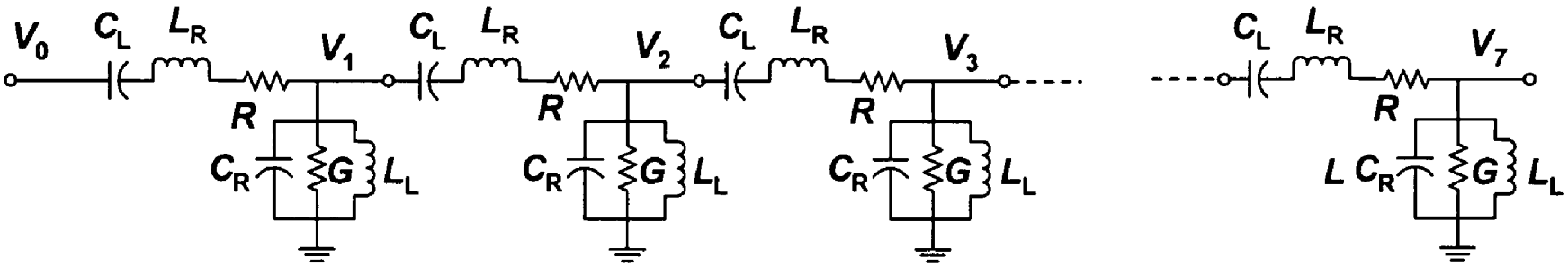
FIG. 8A is a schematic of an equivalent circuit for a 7-cell ZOR according to an embodiment of the present invention.
Figure 8B:
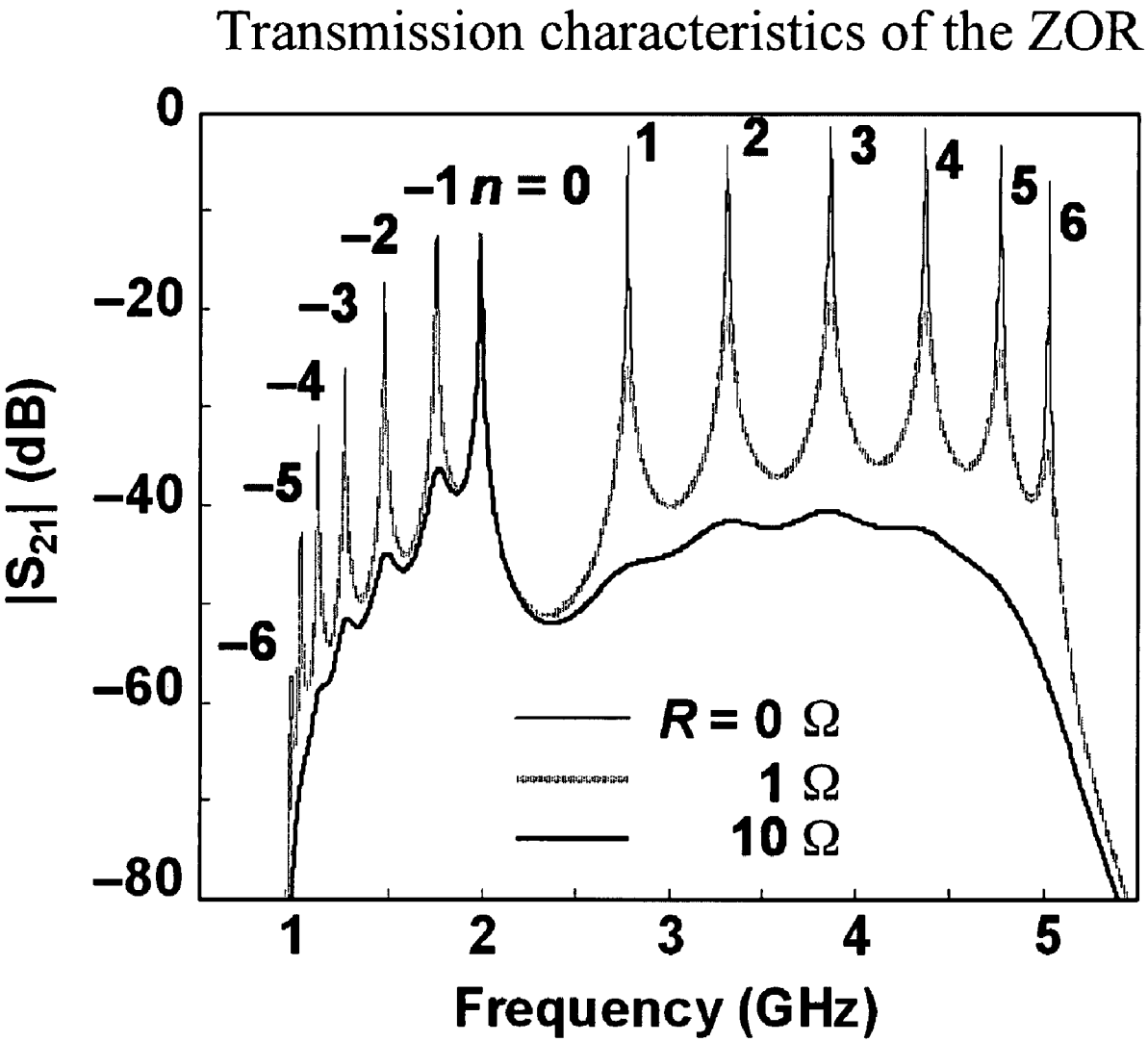
FIG. 8B is a graph of frequency characteristics for the ZOR shown in FIG. 8A.

FIGS. 8A and 8B illustrate the ZOR equivalent circuit and resonant characteristics. The simulation results for the loss calculation based on the equivalent circuit clearly shows an evidence of the independence of the loss of the ZOR from the series resistance R. FIG. 8A shows the transmission characteristics between two ports weakly-coupled to a 7-cell open-ended ZOR shown in FIG. 8B with several parameters of R. The transmission characteristic of the zeroeth-order resonance is not significantly affected by the increasing resistance R as opposed to the other resonant peaks.

On the contrary, the loss of the ZOR is determined by that of the shunt resonant tank circuits. The unloaded Q of the ZOR is calculated by considering the unloaded Q of the equivalent circuit shown in FIG. 4B as the following.

$$\begin{aligned} Q_0 &= \frac{R_0}{\omega_{sh}L_0} = \omega_{sh}R_0C_0 \\ &= \frac{R/N}{\omega_{sh}L/N} = \omega_{sh}(R_0/N)\cdot NC \\ &= \frac{R}{\omega_{sh}L} = \omega_{sh}RC \end{aligned} \tag{10}$$

It is noted from the result of Eq. (10) that the unloaded Q is identical to that of a unit cell alone. This suggests that the unloaded Q of the ZOR is independent of the number of the unit cells. The measured unloaded Q of the 7-cell ZOR calculated from the frequency characteristics of FIG. 6 is 280 and that of the 1.5-cell ZOR calculated from FIG. 7B is 250, which agree in the error range of the quality factor measurements. Incidentally, the unloaded Q of a typical conventional half-wavelength resonator with the same resonant frequency on the same substrate would be 200~300.

3. CONCLUSIONS

A novel zeroeth-order resonator using CRLH-TL has been described, characterized and demonstrated. The novel resonator is characterized by having a resonant frequency which depends only on the shunt inductance and the shunt capacitance of the unit cell, not on the physical resonator length l, thereby allowing fabrication of ultra-compact resonators. In addition, the unusual loss mechanism of the ZOR is revealed and it is shown that the unloaded Q of the ZOR is determined by that of the shunt tank resonant circuit in the unit cell and the improvement of the unloaded Q could be expected with the optimized structure. Experimental and numerical evidences for the validity and usefulness of the ZOR are shown. A size reduction of 61% and an unloaded Q of 250 are obtained for a prototype ZOR with 1.5-cell CRLH-TL at 1.9 GHz in the experiment without any optimization. Further size reduction and improvement of the unloaded Q can be expected with an optimized structure.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A resonator apparatus, comprising:

a composite high frequency right/left-handed (CRLH) transmission line (TL);

means for combining unit cells having a desired equivalent shunt inductance and shunt capacitance within said CRLH-TL; and at least one input and output port on said resonator for coupling high frequency signals into and out of said resonator;

wherein said TL is configured for resonating at the zeroeth-order characterized by an infinite-wavelength wave in the CRLH-TL and has a resonant frequency which is independent of the physical size characteristics of the resonator.

2. A resonator as recited in claim 1:

wherein said high frequency CRLH-TL is configured to operate at a frequency of at least approximately 100 MHz; and wherein at least about an order of magnitude less power is dissipated by the series resistance of said resonator apparatus than with a conventional resonator for the same frequency range.

3. A resonator as recited in claim 1, wherein said CRLH-TL is configured for providing anti-parallel phase and group velocities.

4. A resonator as recited in claim 1, wherein said means for combining unit cells having a desired equivalent shunt inductance and shunt capacitance comprises:

a plurality of passive components in each unit cell;

wherein said passive components include at least one interdigitated capacitor operably coupled to at least one stub inductor; and wherein said passive components from adjacent unit cells are operable coupled to one another within the CRLH-TL, and to said input and output ports.

5. A resonator as recited in claim 4, wherein each said unit cell comprises an interdigitated capacitor and a stub inductor.

6. A resonator apparatus, comprising:

a composite high frequency right/left-handed (CRLH) transmission line (TL);

wherein said CRLH-TL is configured for providing anti-parallel phase and group velocities;

at least 1.5 unit cells having inductors and capacitors formed as microstrips providing a desired equivalent shunt inductance and shunt capacitance within said CRLH-TL;

at least one input and output port on said resonator for coupling high frequency signals into and out of said resonator; and wherein said TL is configured for resonating at the zeroeth-order characterized by an infinite-wavelength wave in the CRLH-TL and has a resonant frequency which is independent of the physical size characteristics of the resonator.

7. A resonator as recited in claim 6, wherein said capacitors comprise interdigitated capacitors.

8. A resonator as recited in claim 7, wherein a capacitive comb attached to a first inductor is positioned in a desired relation with a capacitive comb coupled to a second inductor therein coupling unit cells within said CRLH-TL.

9. A resonator as recited in claim 8, wherein a unit cell comprises a single interdigitated capacitor, formed from two capacitive combs, and coupled to an inductor positioned in a desired relation with said interdigitated capacitor.

10. A resonator as recited in claim 6, wherein said inductors comprises inductive traces, or studs.

11. A resonator as recited in claim 6:

wherein said high frequency of TL is at a frequency within, near, or above the gigahertz range; and wherein at least an order of magnitude less power is dissipated by the series resistance of said resonator apparatus than with a conventional resonator for the same frequency range.

12. A resonator as recited in claim 6, wherein said resonator is a microwave resonator for use in high frequency communication systems, circuit devices, filters, and oscillators.

13. A resonator as recited in claim 6, wherein said at least one input and output port on said resonator comprise conductive input and output trace regions separated from said CRLH-TL by a desired gap distance.

14. A resonator as recited in claim 6, wherein said CRLH-TL may comprise a plurality of unit cells whose number is determined by the desired accuracy of resonator response.

15. A resonator as recited in claim 6, wherein said resonator of N unit cells has a resonant frequency ω following that of the LC tank circuit which has an inductance of $L_L/N$ and a capacitance of $NC_R$, as given by:

$$\omega = \frac{1}{\sqrt{(L_L/N)\cdot NC_R}} = \frac{1}{\sqrt{L_L C_R}} = \omega_{sh}.$$

16. A resonator as recited in claim 6, wherein the unloaded Q of the resonator is substantially independent of the number of unit cells.

17. A resonator as recited in claim 6, wherein said resonator can be created to provide an unloaded Q of at least 250.

18. A method of implementing high frequency resonators, comprising:

forming an inductor-capacitor (LC) unit cell configured to include left-hand wave operation for contributing anti-parallel phase and group velocities;

coupling at least 1.5 unit cells into a composite right/left-handed (CRLH) transmission line (TL) configured for resonating at the zeroeth-order characterized by an infinite-wavelength wave in the CRLH-TL with a resonant frequency which is independent of the physical size characteristics of the resonator; and coupling at least one input port and output port to said CRLH-TL.

19. A method as recited in claim 18, wherein said unit cell is formed comprising coupling at least one interdigitated capacitor to at least one stub inductor.

20. A method as recited in claim 18, wherein said input and output ports are capacitively coupled to said CRLH-TL.

* * * * *